US007845117B2

(12) United States Patent
Kanner

(10) Patent No.: US 7,845,117 B2
(45) Date of Patent: Dec. 7, 2010

(54) ARCH STRUCTURE

(76) Inventor: Moshe Benjamin Kanner, 981 E. 18th St., Brooklyn, NY (US) 11230

( * ) Notice: Subject to any disclaimer, the term of this patent is extended or adjusted under 35 U.S.C. 154(b) by 321 days.

(21) Appl. No.: 11/947,781

(22) Filed: Nov. 30, 2007

(65) Prior Publication Data

US 2010/0024320 A1 Feb. 4, 2010

(51) Int. Cl.
*E04B 1/32* (2006.01)
*E01D 4/00* (2006.01)

(52) U.S. Cl. ..... 52/86; 14/24

(58) Field of Classification Search ..... 52/86, 52/87, 89, DIG. 4, 640, 644, 745.07, 745.08; 14/2, 24, 25; 446/92, 104, 129, 131, 132, 446/137, 138, 139
See application file for complete search history.

(56) References Cited

U.S. PATENT DOCUMENTS

| | | | | |
|---|---|---|---|---|
| 3,717,951 | A * | 2/1973 | Ljungdahl | 446/130 |
| 4,468,902 | A * | 9/1984 | Wilson | 52/81.6 |
| RE34,103 | E * | 10/1992 | Mabey et al. | 52/645 |
| 5,611,181 | A | 3/1997 | Shreiner | |
| 7,100,231 | B2 * | 9/2006 | Peschmann | 14/69.5 |
| 2001/0040070 | A1 | 11/2001 | Apostolopoulos | |
| 2002/0108322 | A1 | 8/2002 | Shreiner | |
| 2006/0214756 | A1 * | 9/2006 | Elliott et al. | 335/306 |
| 2007/0273140 | A1 * | 11/2007 | Bar-Yona | 281/15.1 |

FOREIGN PATENT DOCUMENTS

JP 2005188022 A 7/2005

WO WO 2004110777 A2 * 12/2004

OTHER PUBLICATIONS

Les Industries Ultra Modernes, Printed Oct. 18, 2010, "Mushy Bridge", http://www.ultramoderne.net/?p=3&i=38, 1 page.
Les Industries Ultra Modernes, Printed Oct. 18, 2010, "Mushy Bridge", http://www.ultramoderne.net/?p=3&i=39, 1 page.
Les Industries Ultra Modernes, Printed Oct. 18, 2010, "Mushy Bridge", http://www.ultramoderne.net/?p=3&i=40, 1 page.
Les Industries Ultra Modernes, Printed Oct. 18, 2010, "Mushy Bridge", http://www.ultramoderne.net/?p=3&i=41, 1 page.
Les Industries Ultra Modernes, Printed Oct. 18, 2010, "Mushy Bridge", http://www.ultramoderne.net/?p=3&i=42, 1 page.
Les Industries Ultra Modernes, Printed Oct. 18, 2010, "Mushy Bridge", http://www.ultramoderne.net/?p=3&i=43, 1 page.

* cited by examiner

*Primary Examiner*—David Dunn
*Assistant Examiner*—Benjamin Pevarski
(74) *Attorney, Agent, or Firm*—Law Office of M. Zev Levoritz; Menachem Zev Levoritz

(57) ABSTRACT

This invention concerns an arch structure. In particular, the invention relates to an arch structure comprised of at least two segments which are rotatably linked to each other via hinges or equivalent means to form a continuous bendable chain of attached segments. The segments have magnets above the rotatable or hinged link on opposed end faces, positioned to oppose magnets on confronting end faces of adjacent arch segments, with like poles facing one another, thereby creating a repulsion force. The repulsion force inhibits the arch segments from being brought together and into contact. Due to this effect, the aggregate of the arch segments define an arcuate path (convex upward), maintained by the repulsion forces of the magnets.

15 Claims, 13 Drawing Sheets

ARCH STRUCTURE

BACKGROUND OF THE INVENTION

Arches have been known for centuries to provide a stable means for spanning a space in a manner capable of supporting significant weight. The curved structure defining the arch eliminates, or at least significantly reduces, tensile stresses over a span thereof by substantially resolving the forces into compressive stresses. Generally, an arch structure is made from materials such as masonry, metal and concrete.

SUMMARY OF THE INVENTION

The invention concerns an arch structure comprised of adjacent segments that are rotatably attached to each other. In particular, the invention concerns an arch structure comprised of at least two segments in which adjacent segments are linked to each other via hinges or equivalent means to form a continuous bendable chain of attached segments, and adjacent segments rotate relative to each other about an axis. The segments have magnets above the hinge or equivalent means on opposed end faces, positioned to oppose magnets on confronting end faces of adjacent arch segments, with like poles facing one another, thereby creating a repulsion force. The repulsion force inhibits the arch segments from being brought together. Due to this effect, the aggregate of the arch segments define an arcuate path (convex upward), maintained by the repulsion forces of the magnets.

DETAILED DESCRIPTION OF THE INVENTION

Figure 1:
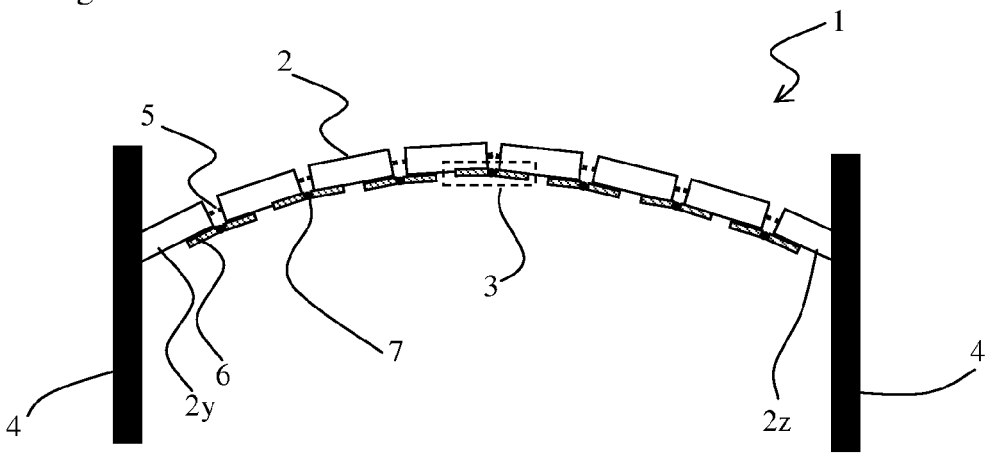
FIG. 1 is a side view of a first exemplary embodiment of an arch structure according to the present invention.

FIG. 1 is a side view of a first exemplary embodiment of the invention. The arch structure 1, as shown in FIG. 1, is comprised of several segments 2, although there may be as few as two segments 2. The segments 2 have top and bottom surfaces as well as ends, which generally face ends of adjacent segments 2, and sides. Although the exemplary embodiment shown has segments with flat top and bottom surfaces, it should be understood that these surfaces could be concave, convex, stepped or any other shape. The segments 2 may be made of any material of suitable strength to carry the load that will be placed upon them. For example, the segments 2 may be made of wood, PVC, steel or concrete. Adjacent segments 2 are connected to each other with a hinge 3 that is secured to the bottom surface of the segments 2 by hinge plates 6 that are rotatably attached by a barrel and pin structure 7. Alternatively, the segments 2 may be connected with ball joints or equivalent structure. The segments 2 may also be connected to each other by their ends or sides by a hinge or equivalent structure.

On the ends of adjacent segments 2, which face each other, there are magnets 5 with opposing polarities, which force the segments 2 to remain apart. The magnets 5 may be neodymium magnets, which have a strong magnetic field and are comparatively light-weight. The magnets 5 may also be electromagnets, which are provided electric power when one wants the arch structure to maintain an arch shape. Other types of magnets known in the art may be used for the magnets 5 on the segments 2, and the magnets 5 may be a combination of different types of magnets. The magnets 5 may be mounted to the segments 2 with an intervening low permeability material.

The load the arch structure 1 will be required to support before the segments 2 come into contact with each other will determine the number, strength and shape of magnets used. The force between the magnets 5 on the segments may be calculated using Ampère's law of force or may be empirically determined by measuring the repulsive force between two segments when brought within an operational distance and angle that will be experienced by the segments 2 in the arch structure 1. It is understood by one in the art that other mechanical repelling means such as springs or a pneumatic or hydraulic system, may be used as an alternative to or in conjunction with the magnets 5, to provide the repelling force between the segments 2.

The end segments 2*y* and 2*z* at the ends of the arch structure 1 are attached to abutments 4. The abutments 4 may be immovably or rotatably attached by end hinges 32-38 to the end segments 2*y* and 2*z*, as illustrated in FIGS. 1 and 1*b*, respectively. Furthermore, the abutments 4 may be stationary, as illustrated in FIG. 1. Alternatively, the abutments 4, may be rotatably attached to the ground or other support structure by abutment hinges 40-42, as illustrated in FIG. 1*b* and 1*d*, in order to accommodate changes in the arch structure 1 length, due to changes in the load on the arch structure 1. The abutments 4 or the abutment hinges 40-42 may be configured as disclosed in Japanese patent JP 2005-188022, which is hereby incorporated by reference. It should be noted, though, that the abutments 4 rotate independently in FIGS. 1*b* and 1*d* in contrast to the tension legs (5) in JP 2005-188022, which must rotate in the same direction to the same angle. It should also be noted that the end segments 2*y* and 2*z* may be rotatably attached to the abutments 4 whether or not the abutments 4 are rotatably attached to the ground. In FIG. 1*b*, the abutments 4 are shown with no rotation, and in FIG. 1*d*, the abutments 4 are shown rotated in an outward direction and the angles between the segments 2 are reduced.

Figure 1A:
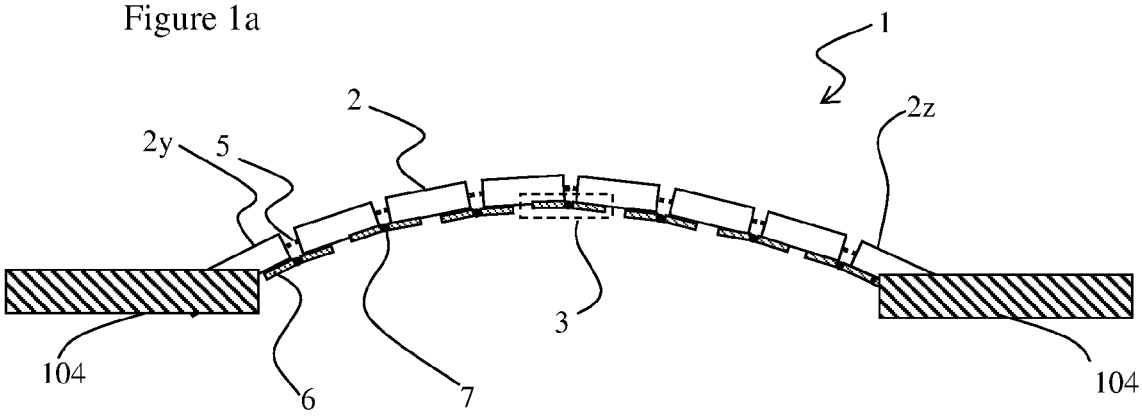
FIG. 1*a* is a side view of an alternative exemplary embodiment wherein end segments are immovably attached to horizontal abutments.
Figure 1B:
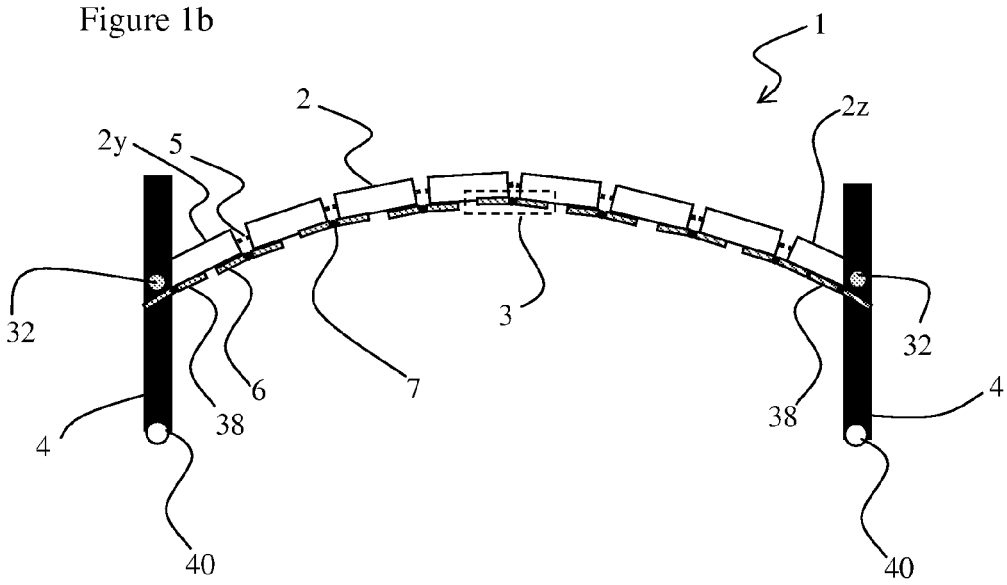
FIG. 1*b* is a side view of an alternative exemplary embodiment wherein end segments are rotatably attached to abutments via hinges or equivalent means and the abutments are rotatably attached to a support surface via hinges or equivalent means (support surface not shown)
Figure 1C:
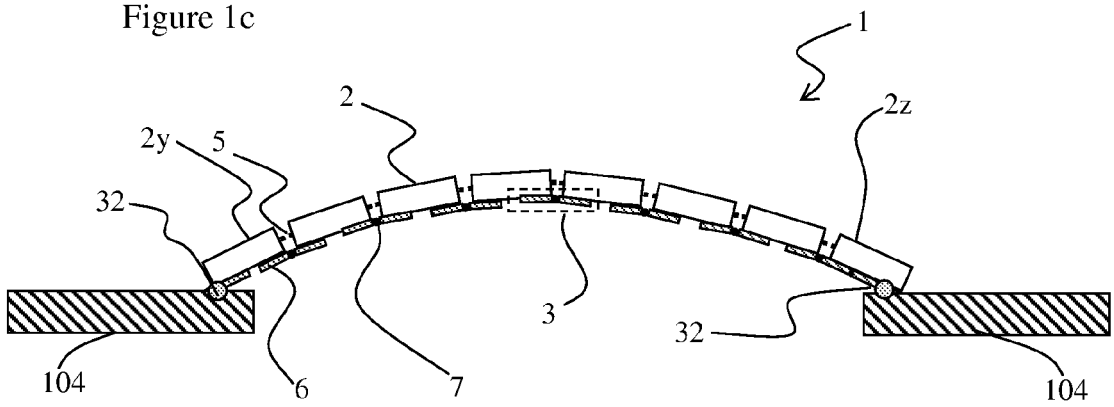
FIG. 1*c* is a side view of an alternative exemplary embodiment wherein end segments are rotatably attached to horizontal abutments.
Figure 1D:
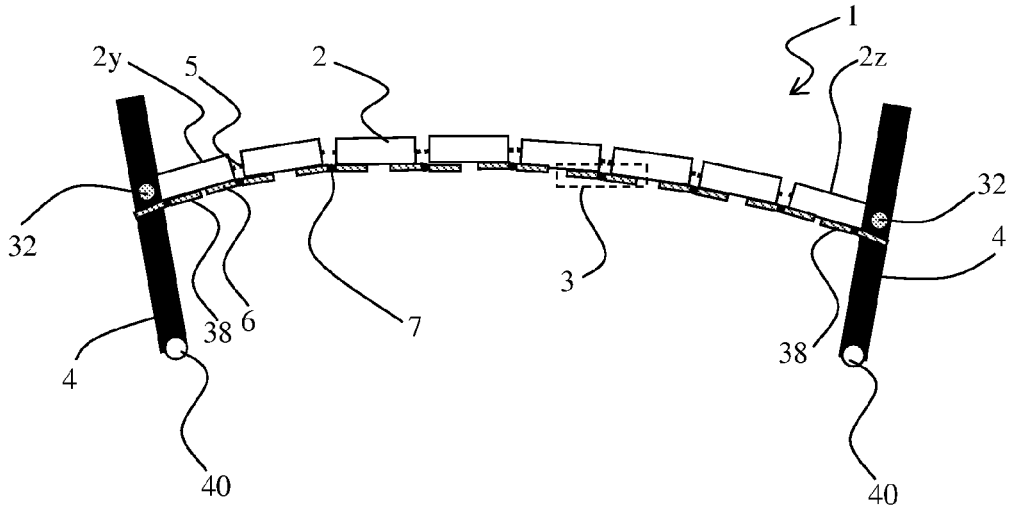
FIG. 1*d* is a side view of the alternative exemplary embodiment of FIG. 1*b* illustrating the rotation of the abutments and the segments due to load forces on the arch structure.
Figure 1E:
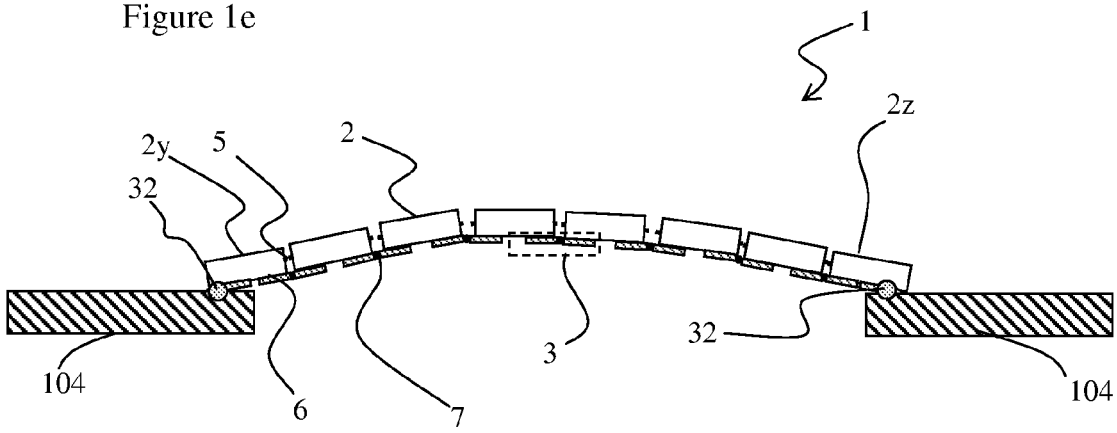
FIG. 1*e* is a side view of the alternative exemplary embodiment of FIG. 1*c* illustrating the rotation of the abutments and the segments due to load forces on the arch structure.

As shown in FIG. 1*a*, the end segments 2*y* and 2*z* may be immovably attached to horizontal abutments 104. The horizontal abutments 104 may be a road, path or simply the ground. Preferably the end segments 2*y* and 2*z* are attached to the horizontal abutments 104 in a manner that provides a relatively smooth and continuous surface between the end segments 2*y* and 2*z* and the horizontal abutments 104. Alternatively, as shown in FIGS. 1*c* and 1*e* the end segments 2*y* and 2*z* may be rotatably attached to the horizontal abutment 104 attached by end hinges 32. In this case, the horizontal abutment 104 may be provided with a transitional surface such as a ramp (not shown) to provide a relatively smooth and continuous surface between the end segments 2*y* and 2*z* and the horizontal abutments 104.

Figure 2:
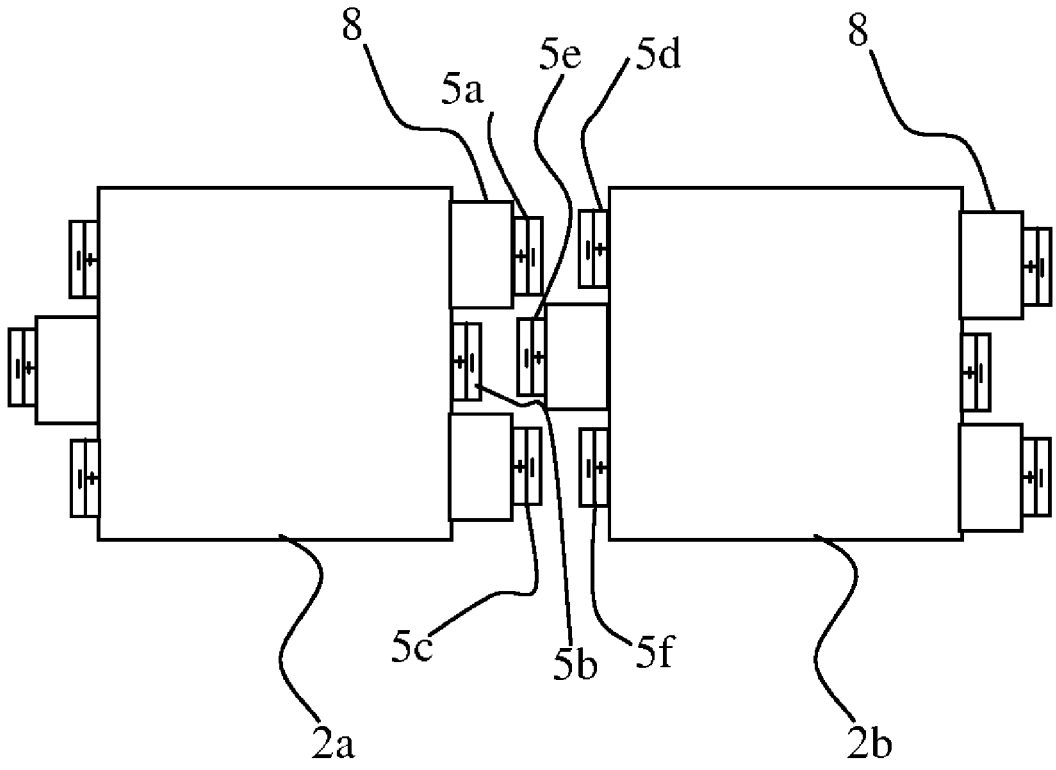
FIG. 2 is a top view of two segments from the exemplary embodiment shown in FIG. 1.

FIG. 2 is a top view of a portion of the first exemplary embodiment of the arch structure 1. The ends of the segments 2 above the hinges 3 have teeth-like projections 8 extending from each segment 2 such that the teeth-like projections 8 fit together in such a manner as to accommodate the gap between the segments 2 and are shaped in such a manner as to provide a relatively continuous surface as the angle and distance of the gap between the segments 2 vary. On the ends of each projection 8 is a magnet 5 whose polarity is opposite to a parallel magnet 5 on the end of the adjacent segment 2. In the exemplary embodiment of the invention shown in FIG. 2, a first set of magnets 5*a*, 5*b* & 5*c* on one end of a first segment 2*a* are configured with opposite polarities to a second set of magnets 5*d*, 5*e* & 5*f* on one end of a second segment 2*b*, although other polarity configurations may be used.

Figure 2A:
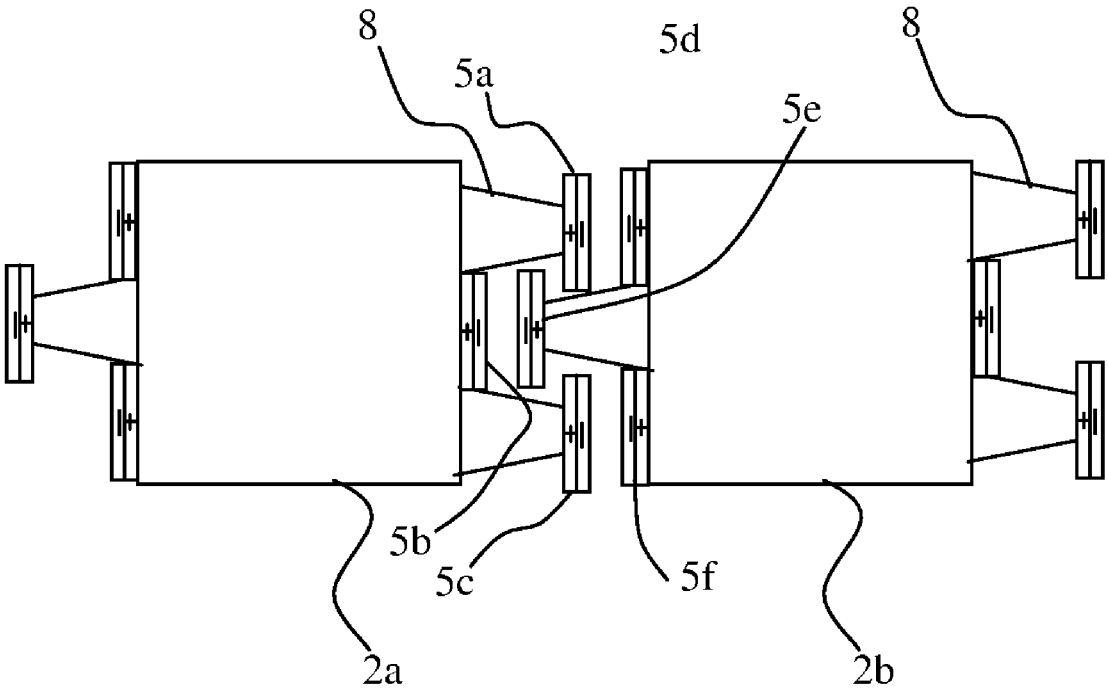
FIG. 2*a* is a top view of two segments from the exemplary embodiment shown in FIG. 1 with an alternative magnet arrangement to prevent "over-arching"

As shown in FIG. 2*a*, according to one alternative embodiment of the invention, the magnets 5 located on the projections 8 are configured, sized and shaped so that those located on adjacent segments develop a repelling force between them that resists any force separating the segments 2 from each other. In the exemplary embodiment shown in FIG. 2*a*, magnets 5*a* and 5*c* on segment 2*a* develop a repelling force with magnet 5*e* on segment 2*b*. The repelling force between the magnets 5 on the projections 8 prevents the structure from "over-arching" i.e. prevents the gap between segments 2 from going beyond a certain distance. This may be useful in certain instances such as when a gust of wind applies an upward force on the bottom surface of the segments 5. It may be understood by one in the art that prevention of "over-arching" may also be accomplished by other structures such as springs or projections from the segments that come into communication with each other when the segments are a predetermined distance apart. These alternative structures may be used alone or in conjunction with the magnets to prevent "over-arching."

Figure 3:
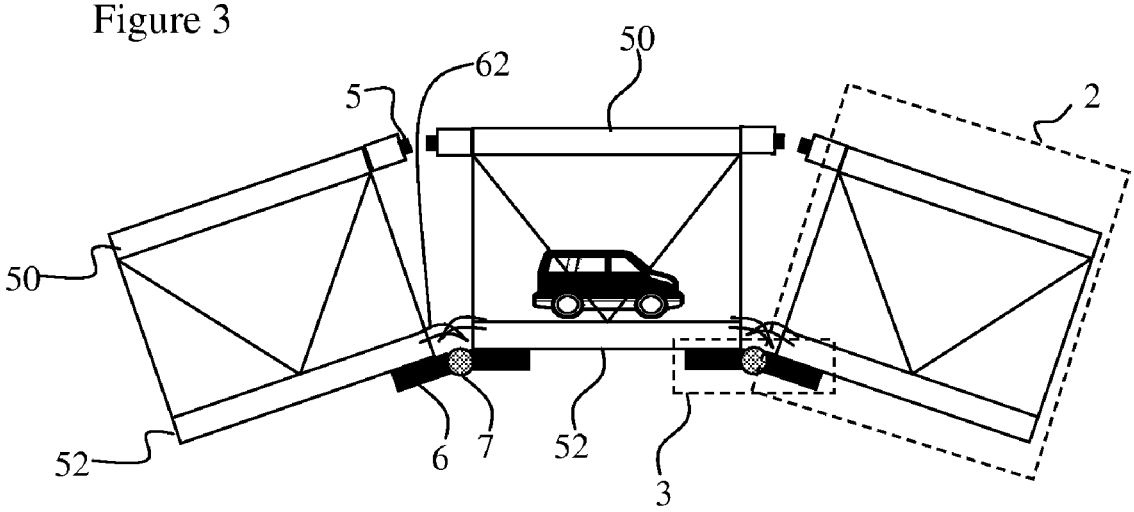
FIG. 3 is a side view of an alternative embodiment of an arch structure according to the present invention wherein each segment is comprised of an upper part and a lower part.
Figure 4:
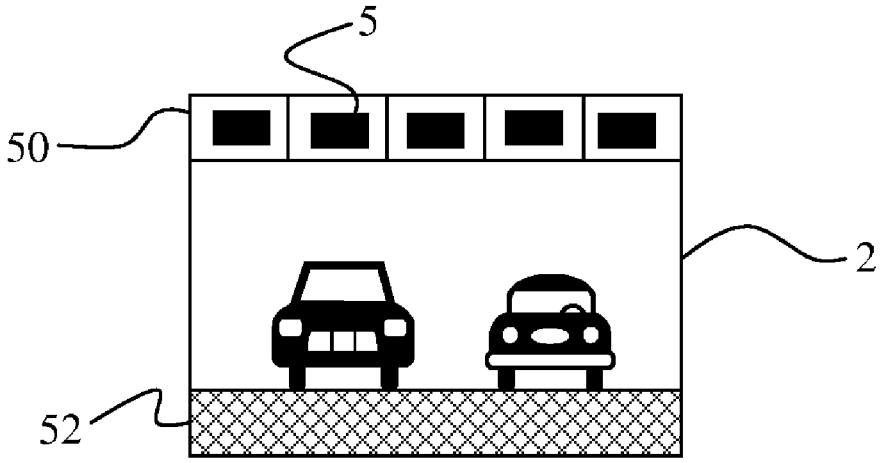
FIG. 4 is a cross-section view of the alternative embodiment of the arch structure of FIG. 3.

As illustrated in FIGS. 3 and 4, the segments 2 may be comprised of an upper part 50 and a lower part 52 that are structurally connected at or by their sides. Magnets 5 with opposing polarities are attached to ends of the upper parts 50 of the segments 2, which face each other. Adjacent segments 2 are connected to each other on the lower parts 52 with the hinge 3 secured to the bottom surface of the segments 2 by hinge plates 6 that are rotatably attached by a barrel and pin structure 7. Alternatively, the segments 2 may be connected with ball joints or equivalent structure. The segments 2 may also be connected to each other by their ends or sides by a hinge or equivalent structure.

Figure 5:
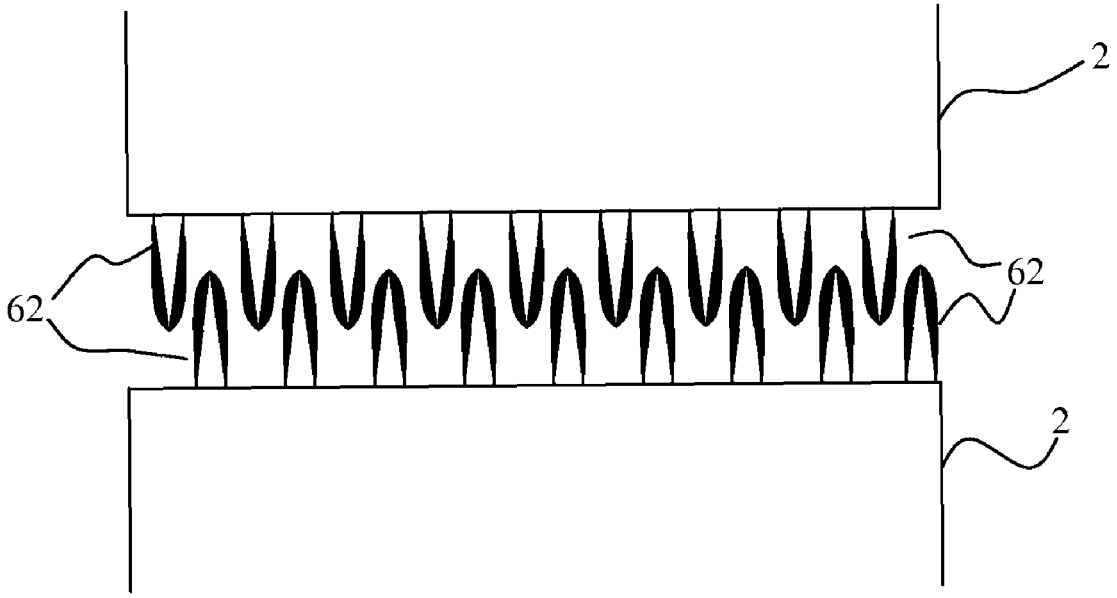
FIG. 5 is a top view of a portion of two segments from the alternative embodiment of the arch structure of FIG. 3 illustrating the interleaving of segment transition teeth between adjacent segments.
Figure 6A:
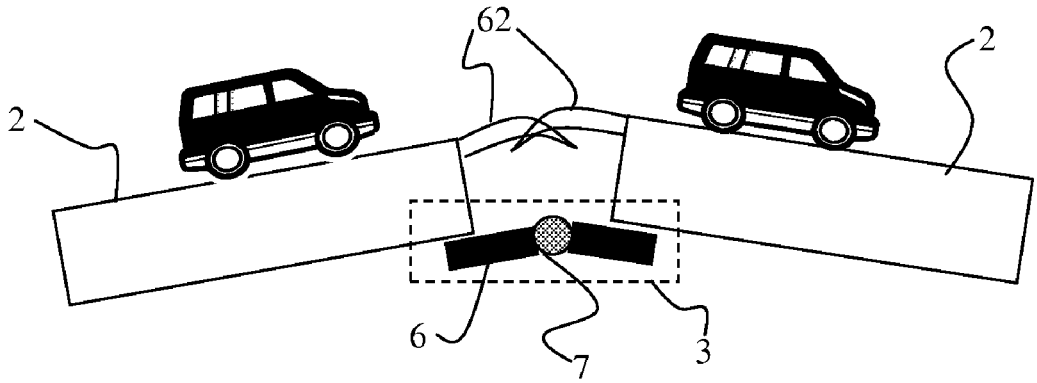
FIGS. 6*a* and 6*b* are side views of two segments at differing angles from the alternative embodiment of the arch structure of FIG. 3 illustrating how the segment transition teeth between adjacent segments maintain a relatively smooth continuous surface as the angle between segments changes.
Figure 6B:
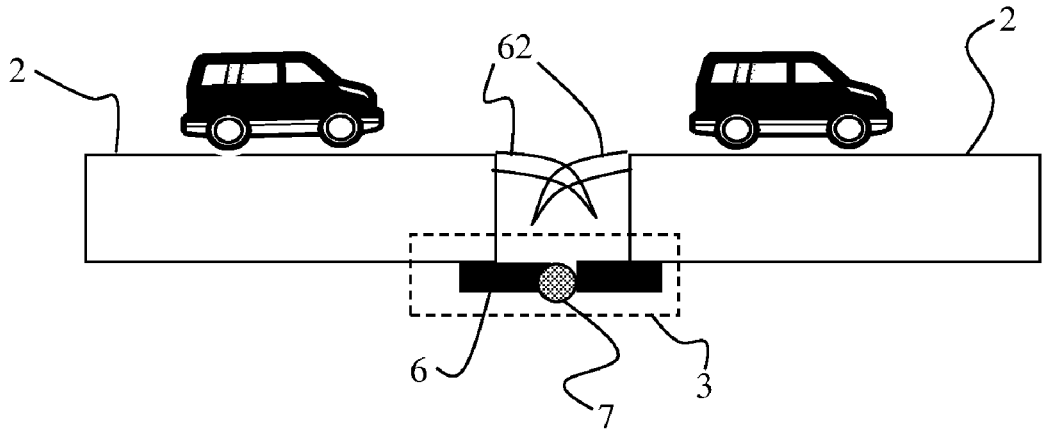

Projecting out from the ends of the segments 2 are several segment transition teeth 62 whose upper surfaces are initially aligned with an upper surface of the lower part 52 and curve in a downward direction. As is illustrated in FIG. 5, the segment transition teeth 62 of adjacent segments 2 are interleaved. As is illustrated in FIG. 6*a* and 6*b*, the segment transition teeth 62 are so shaped and configured so as to provide as smooth and continuous a surface as is practicable between the upper surfaces of the lower parts 52 as the segments 2 rotate relative to each other.

Figure 7:
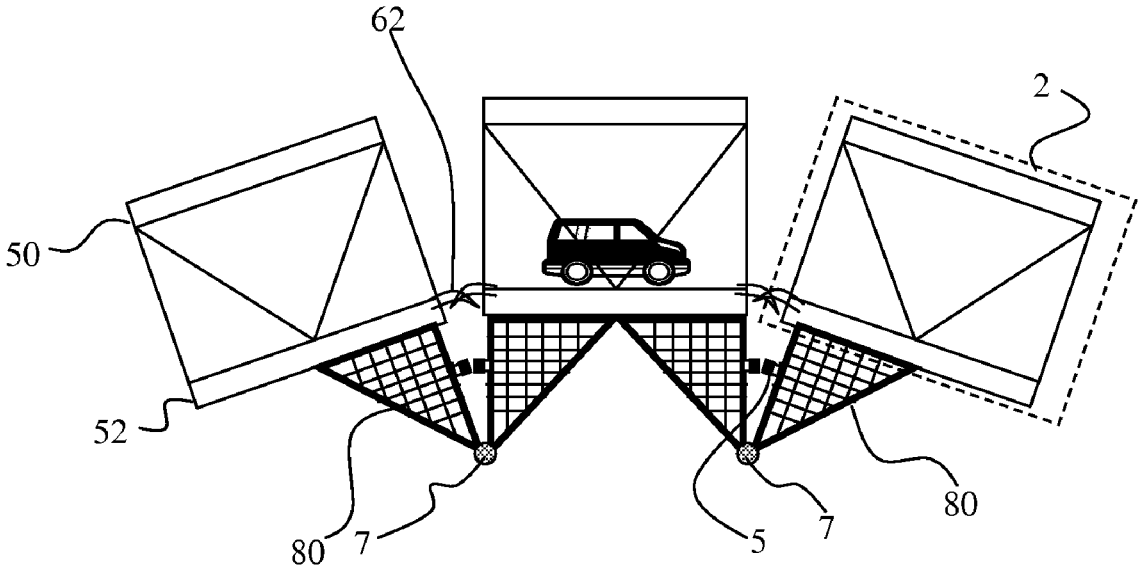
FIG. 7 is a side view of another alternative embodiment of an arch structure according to the present invention wherein adjacent segments are connected by a segment support structure.

In FIG. 7, another alternative exemplary embodiment of the invention is illustrated. Segment support structures 80 are connected to the bottom or side surfaces of the segments 2 and may only be extant by the sides of the segments 2 or they may span the entire width underneath the segments 2. Adjacent segment support structures 80 are connected to each other with a barrel and pin structure 7. On the ends of adjacent segment support structures 80, which face each other, are the magnets 5 with opposing polarities, which force the segments 2 to remain apart. The magnets 5 may be disposed horizontally underneath the segments 2 in a manner similar to that discussed by previous embodiments of the arch structure. Alternatively, or in addition, the magnets 5 may be disposed vertically along the ends of the segment support structures 80 or magnets 5 may be disposed on the upper part 50.

Figure 8:
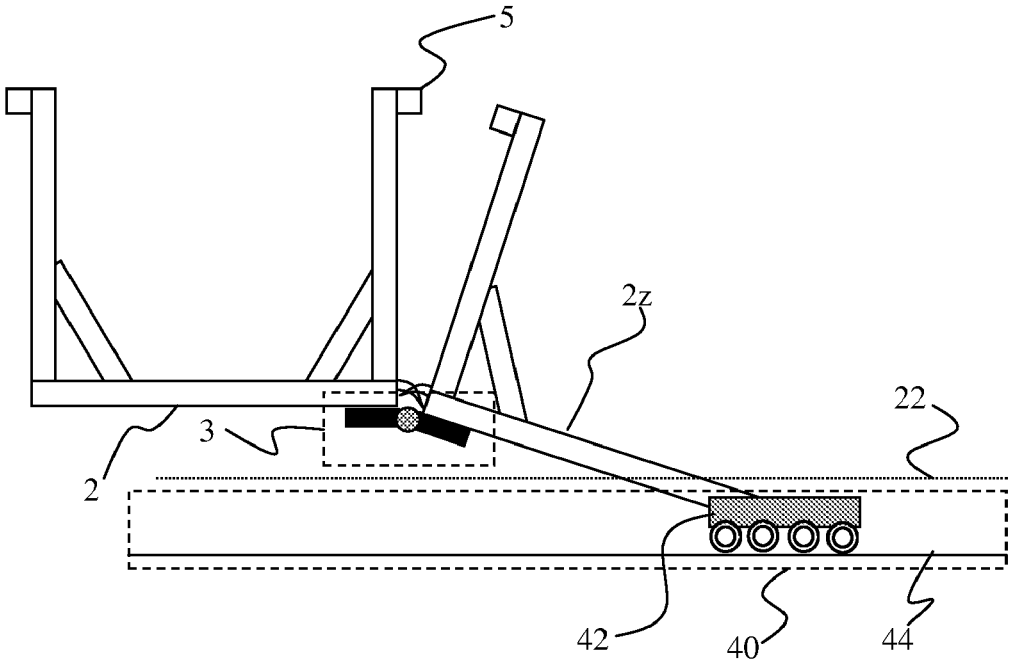
FIG. 8 is a side view of an end portion of an arch structure according to another alternative exemplary embodiment of the present invention wherein the end segment is connected to a sub-road surface mechanism comprised of a flat bed with wheels and a flat support surface.

As discussed above, the end segments 2*y* and 2*z* may be attached to the abutments 4. Alternatively, the end segments 2*y* and 2*z* may be attached to a sub-road surface mechanism 40 below a road 22 leading on to the arch structure 1. The sub-road surface mechanism 40 may be any arrangement that provides substantially vertical support for the arch structure 1 and allows for substantially, possibly limited, horizontal movement for the arch structure 1. As illustrated in FIG. 8 for one end of an exemplary embodiment of the arch structure 1, the end segment 2*z* is attached to the sub-road surface mechanism 40 comprised of a flat bed with wheels 42 and a support surface 44 along which the flat bed 42 may move. The flat bed 42 may be comprised of one or more electric generators with crankshafts that are mechanically connected to the flat bed wheels, for example via a cam shaft, to harness the axial movement of the wheels. Electricity may thereby be generated from the movement of the arch structure 1.

Figure 9:
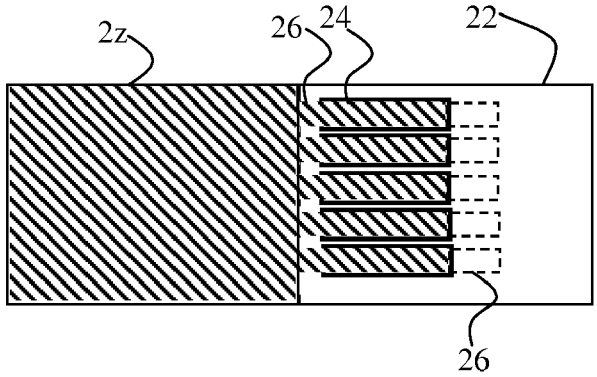
FIG. 9 is a top view of a portion of the end segment of FIG. 8 illustrating how the end segment passes through a road.
Figure 10:
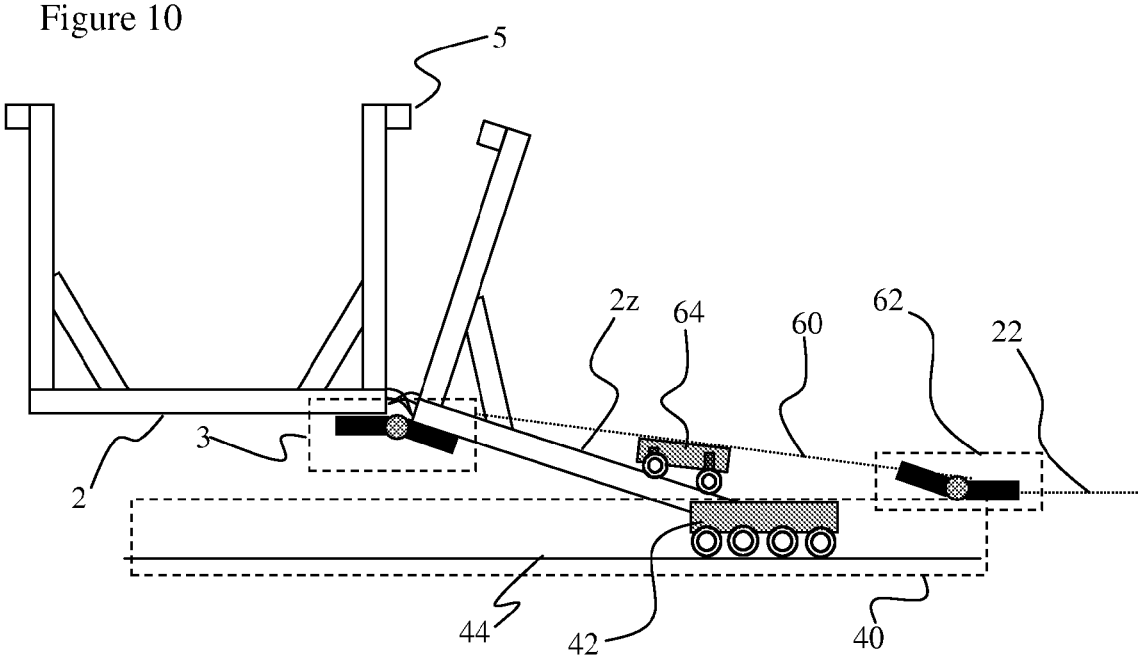
FIG. 10 is a side view of an end portion of an arch structure according to another alternative exemplary embodiment of the present invention wherein the end segment is connected to a sub-road surface mechanism comprised of a flat bed with wheels and a flat support surface and a transition portion of the road is supported by a rolling support above the end segment.

The portion of the end segment 2*z* that intersects with the road 22 may be formed, as illustrated in FIG. 9, of closely spaced spokes 26 that penetrate corresponding road apertures 24 in the road 22. Alternatively, as illustrated in FIG. 10, a transition portion 60 of the road 22 may be supported above the end segment 2*z* by a rolling support 64 and connected to the road 22 by a hinge 62. The rolling support 64 has a suspension system for rolling support wheels 66 to adjust to the changing angles of the end segment 2*z*.

Figure 11:
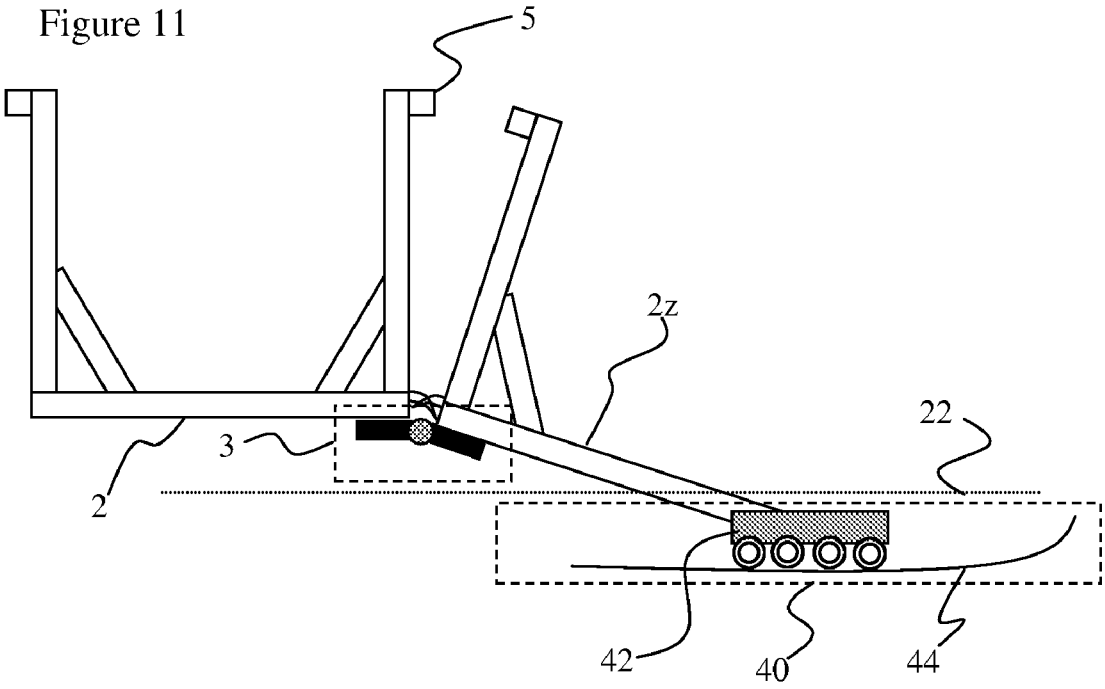
FIG. 11 is a side view of an end portion of an arch structure according to another alternative exemplary embodiment of the present invention wherein the end segment is connected to a sub-road surface mechanism comprised of a flat bed with wheels and a curved support surface.

The support surface 44 may be flat and horizontal, as illustrated in FIG. 8. Alternatively, the support surface 44 may be variably angled to provide a resistance force that increases or decreases as an increasing load forces the arch structure 1 to spread. One such alternative support surface 44 is illustrated in FIG. 11.

The embodiments of the invention described herein are exemplary in nature, and therefore, the spirit and the scope of the invention are by no means restricted to what is described above or intended to represent every possible embodiment of the invention.

What is claimed is:

1. An arch structure, comprising:

two or more segments having end surfaces, the segments rotatably attached to adjacent segments with the end surfaces facing each other;

a plurality of magnets, one or more connected to the segments to provide a repulsive force between adjacent segments relative to the segment end surfaces facing each other; and abutments, wherein segments with end surfaces not facing adjacent segments are attached to abutments.

2. The arch structure of claim 1, wherein the abutments are rotatably attached to a support surface.

3. The arch structure of claim 2, wherein the segments with end surfaces not facing adjacent segments are rotatably attached to the abutments.

4. An arch structure, comprising:

two or more segments having end surfaces, the segments rotatably attached to adjacent segments with the end surfaces facing each other; and a plurality of magnets, one or more connected to the segments to provide a repulsive force between adjacent segments relative to the segment end surfaces facing each other, wherein the end surfaces that face each other have one or more teeth-like projections, the teeth-like projections of the end surfaces that face each other being interleaved.

5. The arch structure of claim 4, wherein a subset of the magnets are disposed on the ends of the teeth-like projections from the end surfaces.

6. The arch structure of claim 5, wherein the magnets disposed on the end of the teeth-like projections are arranged to provide a repulsive force that prevents the arch structure from over-arching.

7. The arch structure of claim 1, wherein the segments are comprised of an upper part and a lower part, the magnets are disposed on the upper part and the segments are rotatably connected on the lower part.

8. The arch structure of claim 7, wherein the segments are further comprised of transition teeth that protrude from the lower part, an upper surface of the transition teeth being initially aligned with an upper surface of the lower part, the transition teeth being sized, shaped and arranged so as to provide a substantially smooth transition between the upper surfaces of the lower parts of adjacent segments for varying angles between the adjacent segments.

9. The arch structure of claim 1, further comprising segment support structures disposed substantially below the segments, wherein the adjacent segments are rotatably attached via the segment support structures.

10. An arch structure, comprising:

two or more segments having end surfaces, the segments rotatably attached to adjacent segments with the end surfaces facing each other;

a plurality of magnets, one or more connected to the segments to provide a repulsive force between adjacent segments relative to the segment end surfaces facing each other; and one or more sub-road surface mechanisms, wherein one or more segments with end surfaces not facing adjacent segments are attached to the sub-road surface mechanisms, the sub-road surface mechanisms being below, above or level with a road surface.

11. The arch structure of claim 10, wherein the sub-road surface mechanism is comprised of a flat bed and a support surface.

12. The arch structure of claim 11, wherein the support surface is curved.

13. The arch structure of claim 10, wherein the sub-road surface mechanism is comprised of an electric generator.

14. The arch structure of claim 10, wherein the end surfaces not facing adjacent segments have one or more spokes connecting the segments to the sub-road surface mechanisms.

15. The arch structure of claim 1, wherein:

the plurality of magnets are disposed on the end surfaces of the segments that face the end surfaces of the adjacent segments.

* * * * *